US010022847B2

(12) United States Patent
Tsai

(10) Patent No.: US 10,022,847 B2
(45) Date of Patent: Jul. 17, 2018

(54) MAGNETIC SLEEVE FOR POSITIONING SCREWDRIVER BIT

(71) Applicant: Chung-Yu Tsai, Taichung (TW)

(72) Inventor: Chung-Yu Tsai, Taichung (TW)

( * ) Notice: Subject to any disclaimer, the term of this patent is extended or adjusted under 35 U.S.C. 154(b) by 156 days.

(21) Appl. No.: 15/151,480

(22) Filed: May 10, 2016

(65) Prior Publication Data

US 2017/0326713 A1 Nov. 16, 2017

(51) Int. Cl.
*B25B 23/12* (2006.01)
*B25B 15/02* (2006.01)

(52) U.S. Cl.
CPC ..... *B25B 23/12* (2013.01); *B25B 15/02* (2013.01)

(58) Field of Classification Search
CPC ..... B25B 23/12; B25B 15/02
USPC ..... 81/438
See application file for complete search history.

(56) References Cited

U.S. PATENT DOCUMENTS 8,857,300 B2 * 10/2014 Lai ..... B25B 13/56 403/322.2
2013/0328276 A1 * 12/2013 Moss ..... B25B 23/0035 279/102
2016/0016298 A1 * 1/2016 Zhang ..... B25B 15/001 81/451
2017/0120428 A1 * 5/2017 Wang ..... B25B 23/12

* cited by examiner

*Primary Examiner* — Hadi Shakeri

(57) ABSTRACT

An apparatus includes a body, a sleeve, a magnetic member and an engaging member. The body includes a function end and a first groove with first and second end faces. The sleeve includes a first room and a reception area defined therein. A second groove is defined in the outside of the sleeve and located corresponding to the first groove. The second groove includes holes defined radially therethrough which communicates with the reception area. The magnetic member is receive in the first room. The engaging member is engaged with the second groove and has first portions inserted through the holes in the second groove. The second engaging portion is connected to the first engaging portions and protrudes beyond the reception area so as to be engaged with the first groove of the body and movable between the first and second end faces of the first groove.

8 Claims, 9 Drawing Sheets

MAGNETIC SLEEVE FOR POSITIONING SCREWDRIVER BIT

BACKGROUND OF THE INVENTION

1. Fields of the Invention

The present invention relates to an apparatus having a magnetic sleeve which is slidably mounted to a screwdriver bit which is not separated from the magnetic sleeve during operation.

2. Descriptions of Related Art

The conventional magnetic sleeve is disclosed in U.S. Pat. No. 7,107,882 B1 and Taiwan Patent No. 1254660, and comprises a screwdriver having a handle with a shank extending therefrom, the screwdriver having a tip at an end opposite the handle, the shank having a fastening groove formed thereon adjacent the tip, the fastening groove defining narrow diameter on the shank and a shoulder adjacent the tip; a hollow sleeve having a fastening rim slidably positioned over the fastening groove of the shank, the shoulder abutting the fastening rim when the sleeve sides outwardly of the tip so as to retain the sleeve on the shank, the fastening rim extending inwardly at one end of the sleeve; and a magnetic part affixed to an opposite end of the sleeve, the magnetic part having an outer surface suitable for magnetically connecting to a screw head, the magnetic part having interior passageway, the tip of the screwdriver slidable through the interior passageway as the fastening rim moves toward the shoulder.

However, the inner diameter of the fastening rim is smaller than the outer diameter of the front part. The magnetic sheath is made by hard plastic so that the fastening rim is forced to move over the front part, and when fastening rim reaches the groove, the inner diameter returns to its initial size, so that the magnetic sheath is difficult to be separated from the screwdriver's shank because the inner diameter of the fastening rim is smaller than the outer diameter of the screwdriver's shank.

The shortcomings of the magnetic sheath are that the magnetic sheath is integrally made of plastic, if the inner diameter of the fastening rim is not tightly engaged with the groove, the magnetic sheath may slide within the groove and cannot be well positioned. On the contrary, if the inner diameter of the fastening rim is tightly engaged with the groove, the magnetic sheath is difficult to slide. If the magnetic sheath is made of soft material, the magnetic sheath may be deformed when the user grabs it to move, and the fastening rim of the magnetic sheath may even be disengaged from the groove. Furthermore, the magnetic sheath has only one color which may not be satisfied by some users.

The present invention intends to provide an apparatus to provide a magnetic sleeve and a screwdriver bit, and eliminates the shortcomings mentioned above.

SUMMARY OF THE INVENTION

The present invention relates to an apparatus and comprises a body having a function end on one end thereof, and a first groove is defined in the outside of the body and includes a first end face and a second end face respectively formed on two ends of the first groove.

A sleeve has a reception area defined therein, and a first room is defined in the first end of the sleeve and axially communicates with the reception area. A second groove is defined in the outside of the sleeve and located close to the second end of the sleeve. The inner diameter of the first room is larger than that of the reception area. The second groove is located corresponding to the first groove. Multiple holes are defined through the wall of the second groove, so that the second groove and the reception area and the first groove are in communication with each other.

A ring-shaped magnetic member is received in the first room and has a second room which communicates with the reception area. An engaging member is a resilient member and has first engaging portions and a second engaging portion. The engaging member is mounted to the second groove of the sleeve. The first engaging portions are inserted through the holes. The second engaging portion protrudes beyond the reception area and is mounted to the outside of the first groove. The second engaging portion is movable between the first and second end faces. The second engaging portion has a rounded inner periphery so as to be engaged with the firs groove when the body extends through the sleeve such that the sleeve does not separated from the body.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
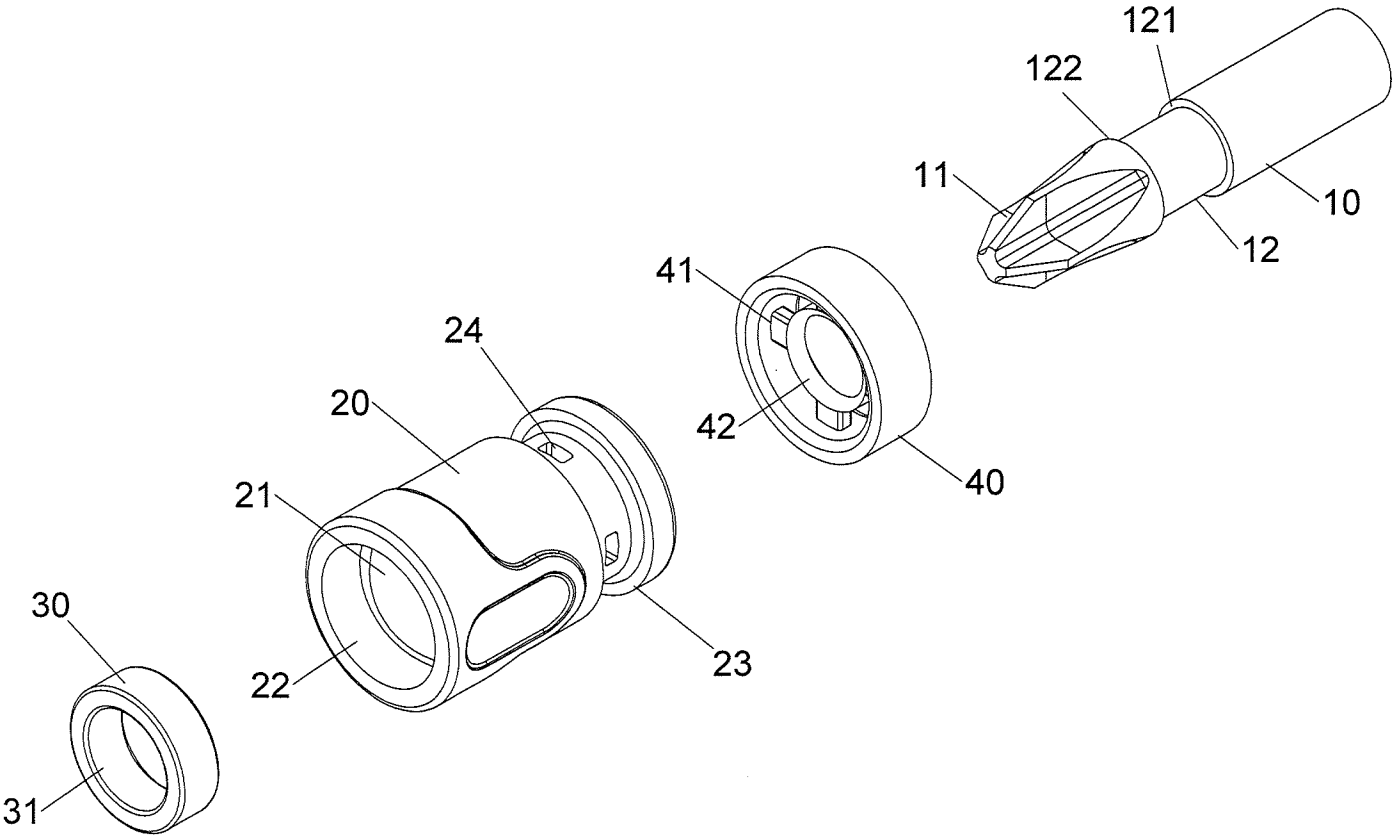
FIG. 1 is an exploded view of the apparatus of the present invention.
Figure 3:
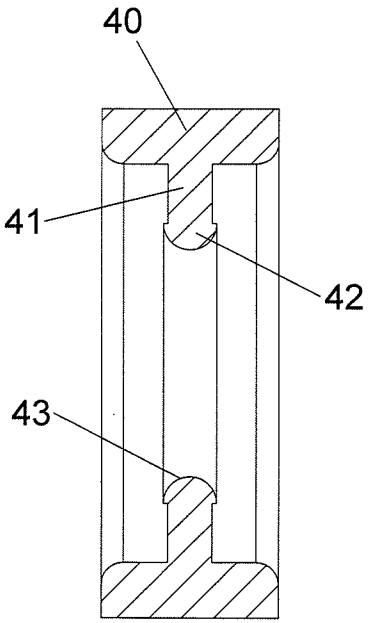
FIG. 3 is a cross sectional view, taken along line 3-3 in FIG. 2.
Figure 2:
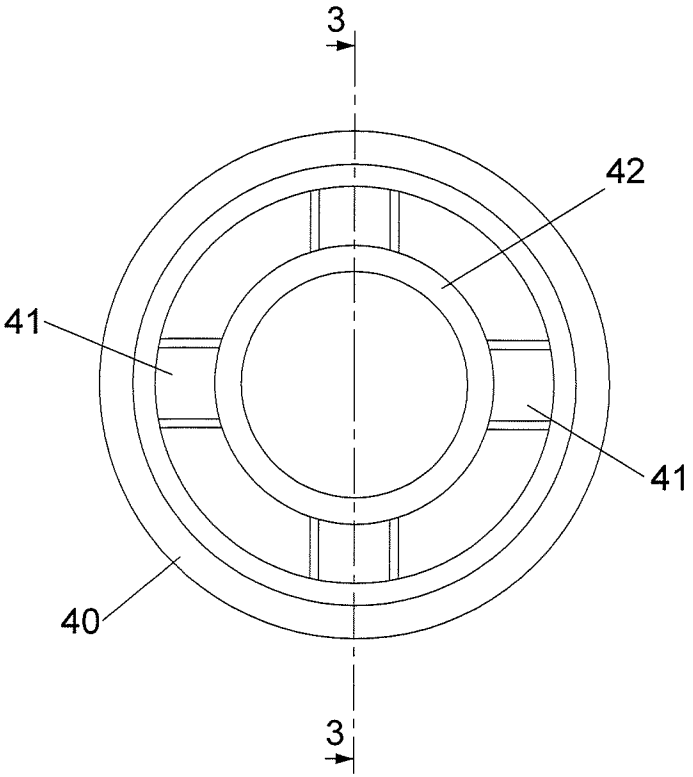
FIG. 2 is an end view to show the engaging member of the apparatus of the present invention.
Figure 4:
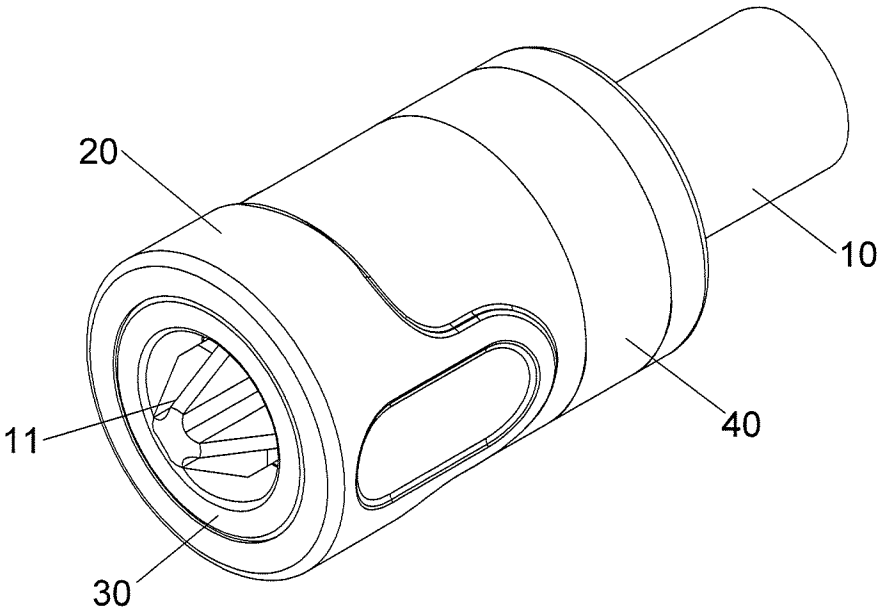
FIG. 4 is a perspective view to show the apparatus of the present invention.

Referring to FIGS. 1 to 4, the apparatus of the present invention comprises a body 10 having a function end 11 on one end thereof, and a first groove 12 is defined in the outside of the body 10. The outer diameter of the first groove 12 is smaller than that of the body 10 so as to form a first end face 121 and a second end face 122 respectively on two ends of the first groove 12.

A sleeve 20 has a reception area 21 defined therein, and a first room 22 is defined in the first end of the sleeve 20 and axially communicates with the reception area 21. A second groove 23 is defined in the outside of the sleeve 20 and located close to the second end of the sleeve 20. The inner diameter of the first room 22 is larger than that of the reception area 21. The second groove 23 is located corresponding to the first groove 12 when the body 10 extends through the sleeve 20. Multiple holes 24 are defined through the wall of the second groove 23, so that the second groove 23 and the reception area 21 and the first groove 12 are in communication with each other.

A ring-shaped magnetic member 30 is received in the first room 22 and has a second room 31 which communicates with the reception area 21. An engaging member 40 is a resilient member and has first engaging portions 41 and a second engaging portion 42. The engaging member 40 is mounted to the second groove 23 of the sleeve 20. The first engaging portions 41 are inserted through the holes 24. The second engaging portion 42 protrudes beyond the reception area 21 and is mounted to the outside of the first groove 12. The second engaging portion 42 is movable between the first and second end faces 121, 122.

When the body 10 extends through the sleeve 20, the function end 11 is located in the reception area 21 and protrudes beyond the end face of the magnetic member 30. The second engaging portion 41 has a rounded inner periphery 43 so as to be engaged with the first groove 12 when the body 10 extends through the sleeve 20 such that the sleeve 20 does not separated from the body 10. The sleeve 20 is made of plastic or rubber, any harder material can also be used to make the sleeve 20. The engaging member 40 is made of plastic or rubber, any harder material can also be used to make the engaging member 40. The sleeve 20 and the engaging member 40 are made by different material and may have different colors. After the sleeve 20 is made by way of injection molding, the sleeve 20 is put in the mold set for making the engaging member 40, and the engaging member 40 is then made by way of injection molding to allow the engaging member 40 to be set in the second groove 23 and the holes 24.

Figure 6:
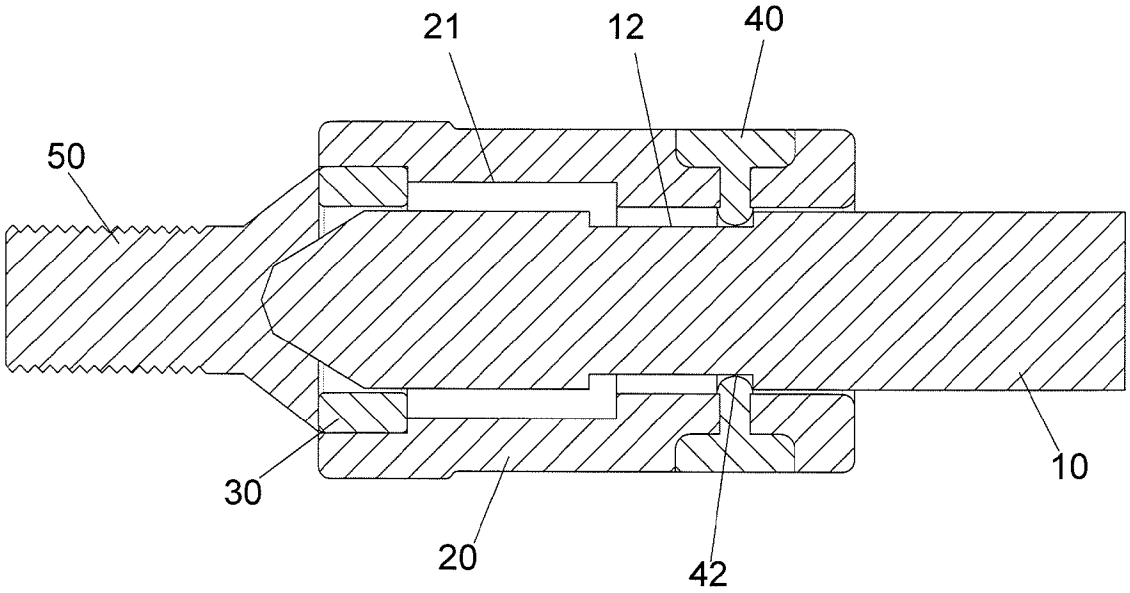
FIG. 6 is a cross sectional view, taken along line 6-6 in FIG. 5.
Figure 5:
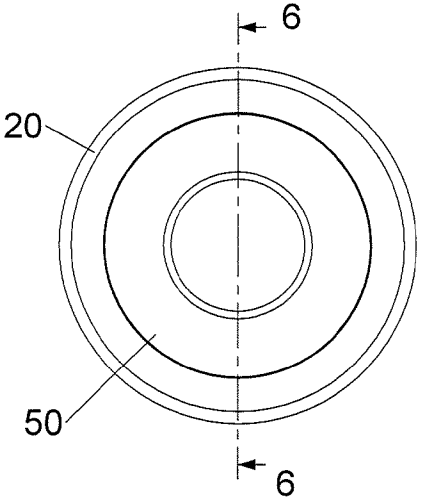
FIG. 5 is an end view of the sleeve of the apparatus of the present invention.
Figure 7:
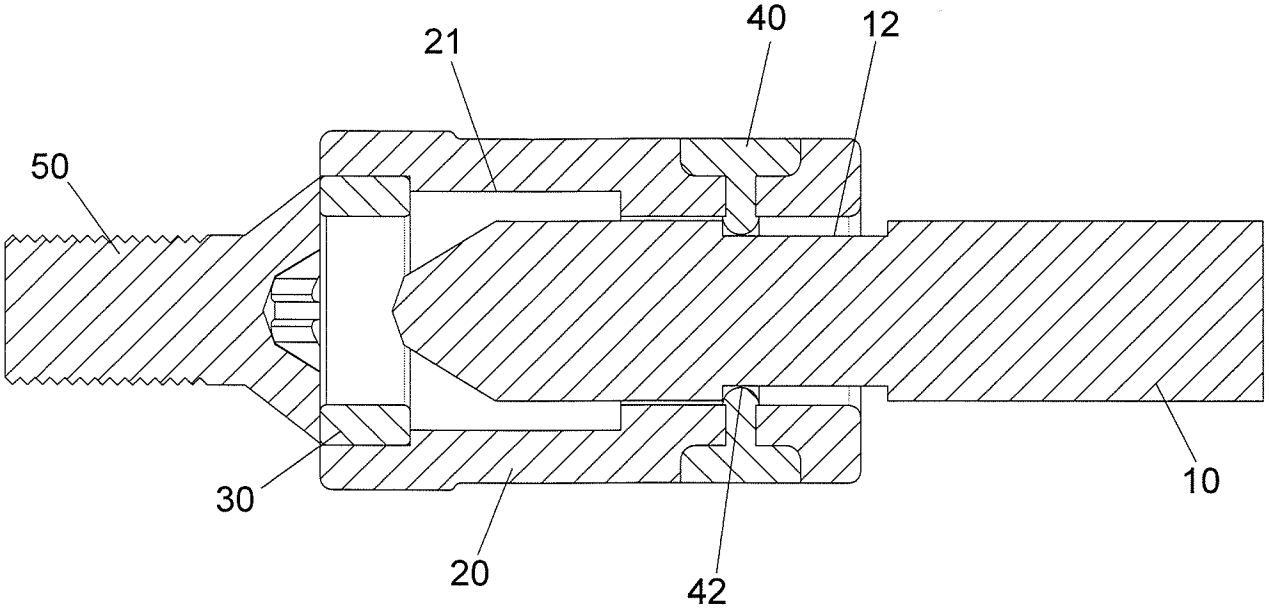
FIG. 7 is another cross sectional view, taken along line 6-6 in FIG. 5.

As shown in FIGS. 5 to 7, the first groove 12 is long enough to allow the sleeve 20 and the engaging member 40 to move a pre-set distance therein. When the user wants to use the function end 11 to drive an object 50, the sleeve 20 and the engaging member 40 are moved to let the second engaging portion 42 contact the first end face 121. Therefore, the function end 11 extend beyond the end face of the magnetic member 30 and is engaged with the object 50. The magnetic member 30 attracts the object 50 and the function end 11 does not separate from the object 50. When the user wants to remove the object 50, the sleeve 20 is moved to let the second engaging portion 42 contact the second end face 122, therefore, the function end 11 is retracted into the reception area 21 and separated from the object 50 which is still attracted on the magnetic member 30. The user can then easily remove the object 50 from the magnetic member 30.

Figure 8:
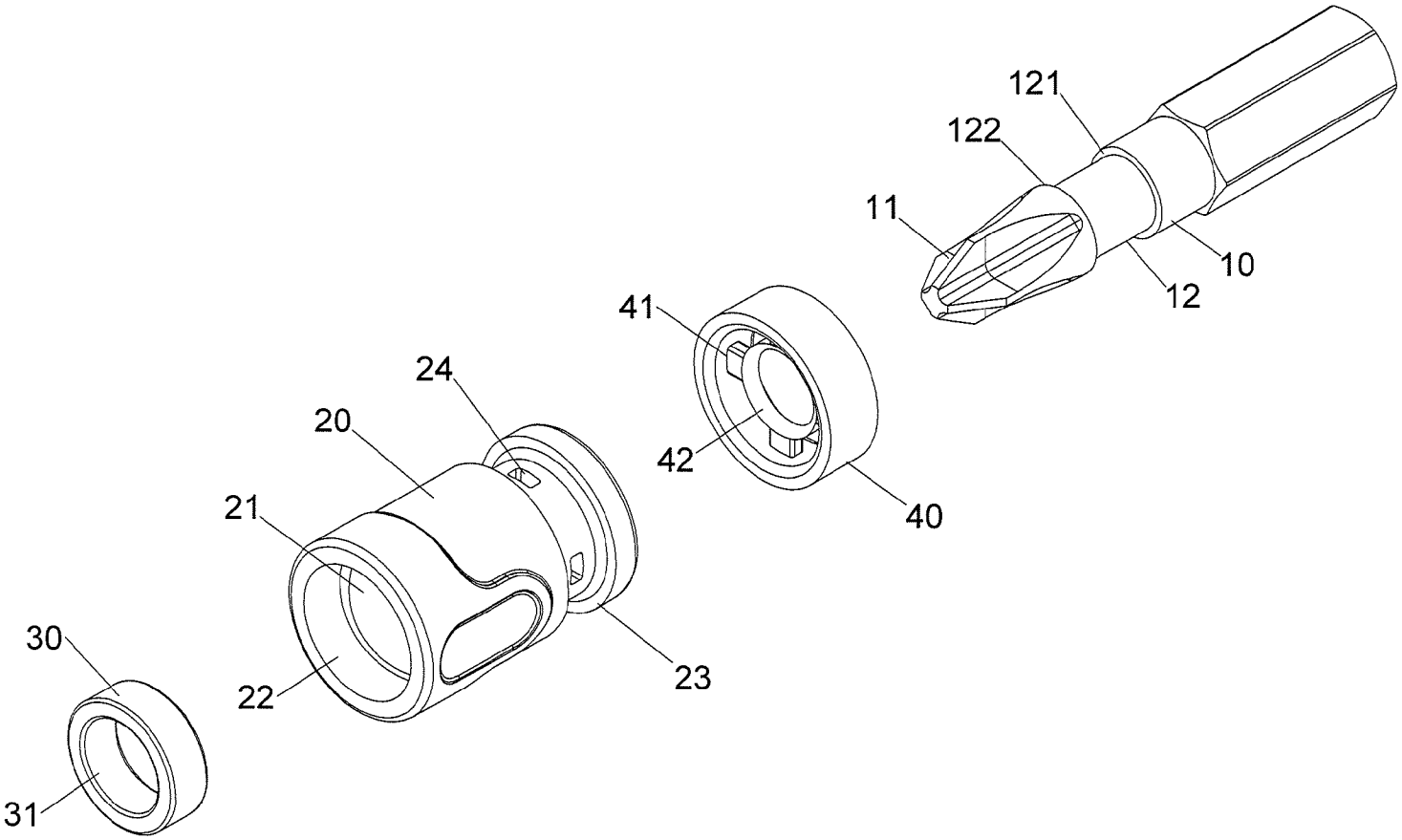
FIG. 8 is an exploded view of the second embodiment of the apparatus of the present invention.
Figure 9:
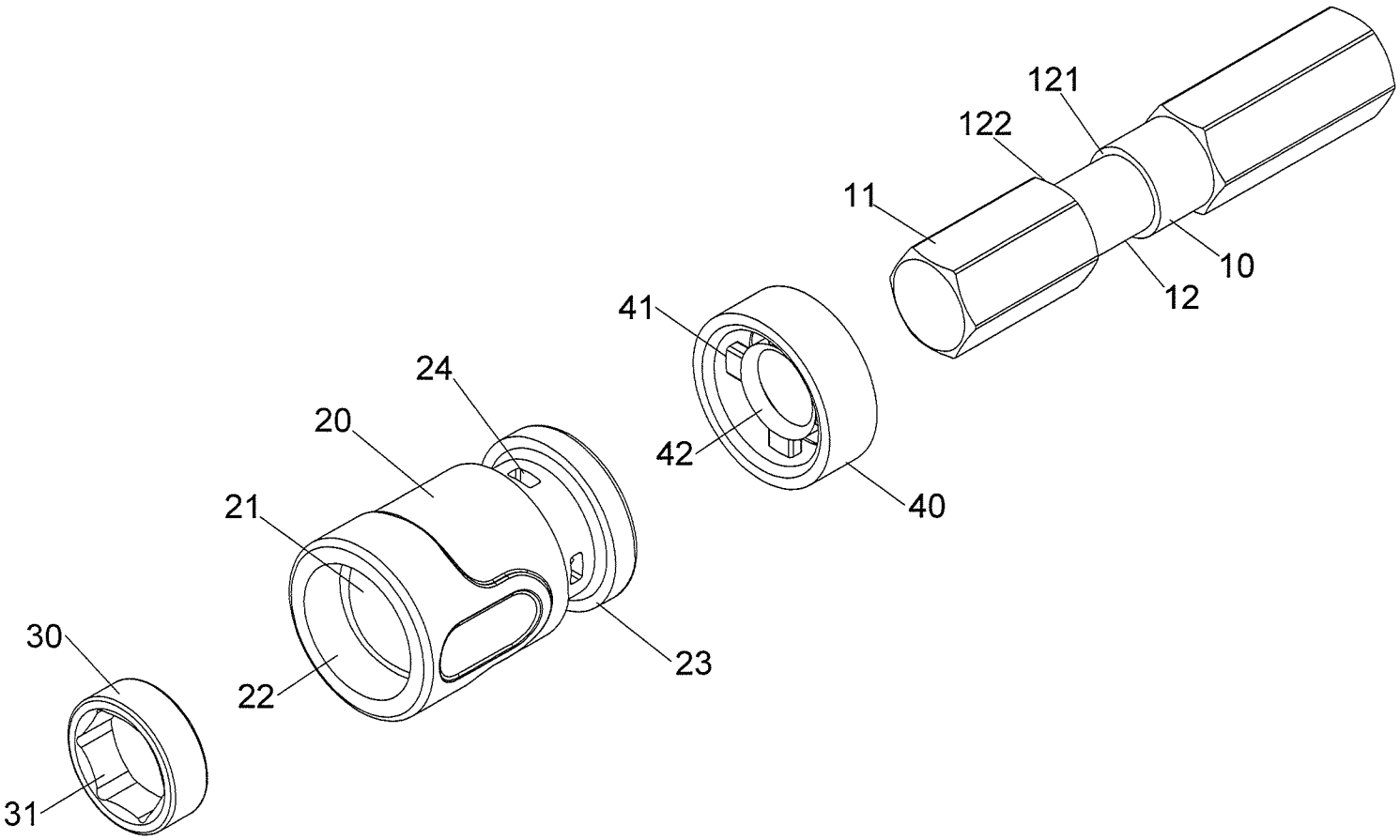
FIG. 9 is an exploded view of the third embodiment of the apparatus of the present invention.

As shown in FIG. 8, the body 10 is a screwdriver or a screwdriver bit. As shown in FIG. 9, the body 10 is a hexagonal wrench.

Figure 10:
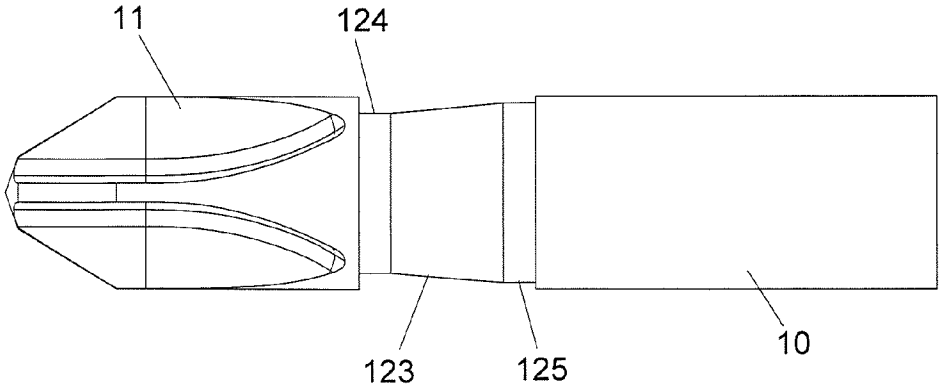
FIG. 10 is a side view of the fourth embodiment of the apparatus of the present invention.

As shown in FIG. 10, the outside of the first groove 12 of the body 10 includes a tapered face 123 which is connected between a first end section 124 and a second end section 125. Both of the first and second end sections 124, 125 has an even outer diameter. The first end section 124 is located close to the function end 11. The outer diameter of the first end section 124 is smaller than the outer diameter of the second end section 125. The outer diameter of the second end section 125 is smaller than that of the body 10.

Figure 11:
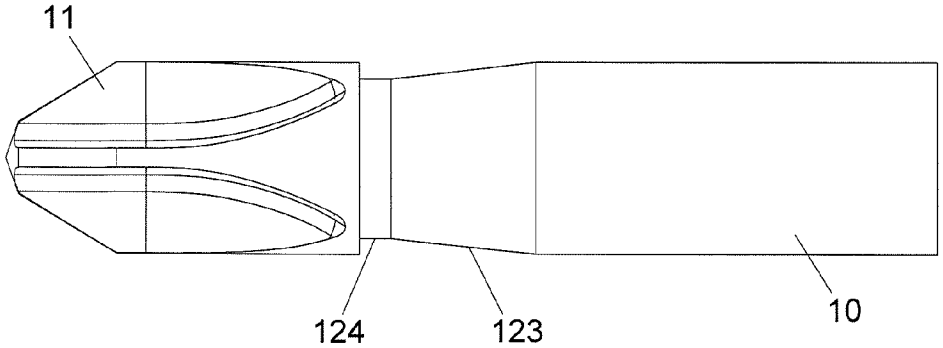
FIG. 11 is a side view of the fifth embodiment of the apparatus of the present invention.

As shown in FIG. 11, the outside of the first groove 12 of the body 10 includes a tapered face 123 which has a first end connected to the first end section 124. The first end section 124 is located close to the function end 11. The outer diameter of the second end of the tapered face 124 is the same as that of the body 10. When the body 10 is going to reach an object 50 in a deep hole, and the outer diameter of the sleeve 20 is larger than the n inner diameter of the deep hole, the sleeve 20 is not restricted by the first end face 121 of the body 10 and is movable along the body 10 so that the body 10 is inserted into the deep hole.

Figure 14:
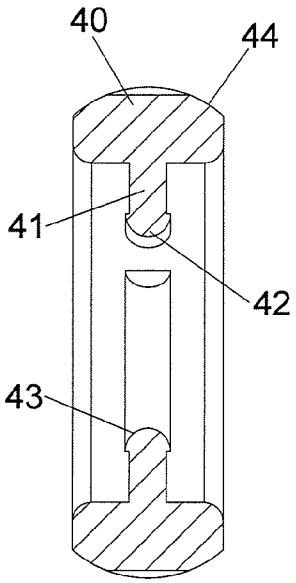
FIG. 14 is another cross sectional view, taken along line 14-14 in FIG. 13.
Figure 13:
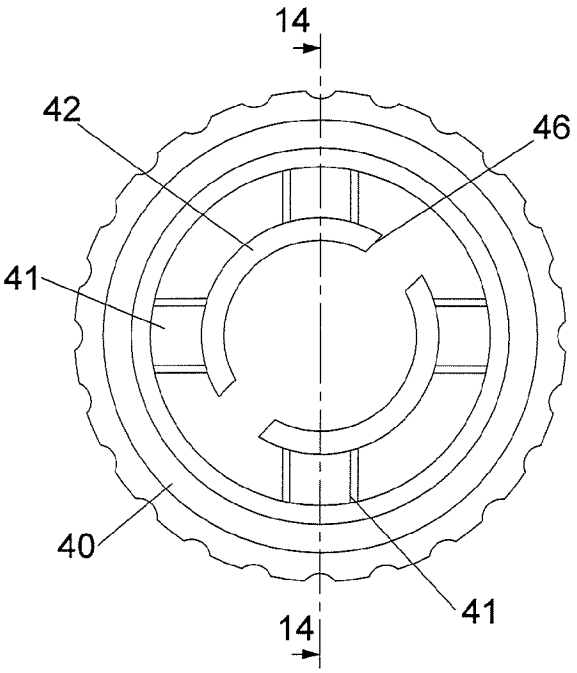
FIG. 13 is an end view of the engaging member of the sixth embodiment of the apparatus of the present invention.
Figure 12:
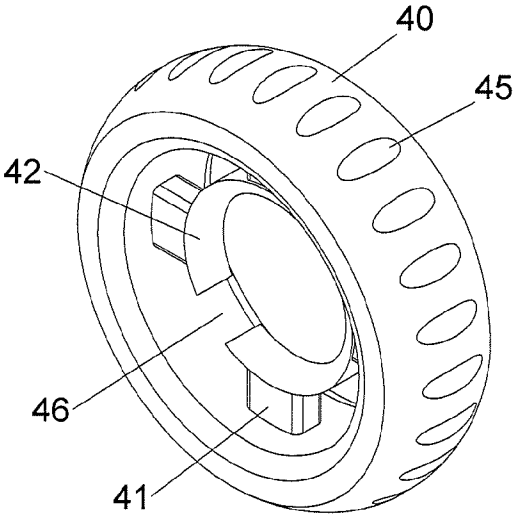
FIG. 12 is a perspective view of the engaging member of the sixth embodiment of the apparatus of the present invention.

As shown in FIGS. 12 to 14, the engaging member 40 has a curved outer face 44, and multiple oval patterns 45 radially protrude beyond the curved outer face 44. The second engaging portion 42 has two openings 46 to provide flexibility to the second engaging portion 42.

The present invention has the advantages which are that the engaging member 40 is located in the second groove 23 and the holes 24 so that when the sleeve 20 is mounted to the body 10, the second engaging portion 42 is engaged with the first groove 12 to position the sleeve 20 relative to the first groove 12.

The engaging member 40 has a certain level of flexibility, the second engaging portion 42 is movable along the first groove 12 while a resilient friction is formed between the sleeve 20 and the first groove 12.

The sleeve 20 is made to have better grip feature. The engaging member 40 and the sleeve 20 have different colors.

The first groove 12 allows the sleeve 20 and the engaging member 40 to move a pre-set distance, and the sleeve 20 is not separated from the body 10.

As shown in FIGS. 6 and 7, the object 50 is attracted on the magnetic member 30, and the magnetic member 30 is shifted to separate the object 50 from the function end 11. As shown in FIG. 7, when the object 50 is removed from a threaded hole (not shown), the object 50 is attracted on the magnetic member 30 and does not drop randomly.

While we have shown and described the embodiment in accordance with the present invention, it should be clear to those skilled in the art that further embodiments may be made without departing from the scope of the present invention.

What is claimed is:

1. An apparatus comprising:

a body having a function end connected to one end thereof, a first groove defined in an outside of the body and includes a first end face and a second end face respectively formed on two ends of the first groove;

a sleeve having a reception area defined therein, a first room defined in a first end of the sleeve and axially communicating with the reception area, a second groove defined in an outside of the sleeve and located close to a second end of the sleeve, an inner diameter of the first room being larger than that of the reception area, the second groove located corresponding to the first groove, multiple holes defined through a wall of the second groove, the second groove and the reception area and the first groove being in communication with each other;

a ring-shaped magnetic member received in the first room and having a second room which communicates with the reception area, and an engaging member being a resilient member and being formed in the second groove by an injection molding to have multiple first engaging portions extending through the holes respectively and a second engaging portion protruding beyond the reception area and mounting to an outside of the first groove; the second engaging portion being movable between the first and second end faces, the second engaging portion having a rounded inner periphery so as to be engaged with the first groove when the body extends through the sleeve such that the sleeve does not separated from the body, the sleeve being made of plastic or rubber, the engaging member being made of plastic or rubber, the sleeve and the engaging member being made by different material.

2. The apparatus as claimed in claim 1, wherein the body is a screwdriver or a screwdriver bit.

3. The apparatus as claimed in claim 1, wherein the body is a hexagonal wrench.

4. The apparatus as claimed in claim 1, wherein the outside of the first groove of the body includes a tapered face which is connected between a first end section and a second end section, the first end section is located close to the function end, an outer diameter of the first end section is smaller than an outer diameter of the second end section, the outer diameter of the second end section is smaller than that of the body.

5. The apparatus as claimed in claim 1, wherein the outside of the first groove of the body includes a tapered face which has a first end connected to a first end section, the first end section is located close to the function end, an outer diameter of a second end of the tapered face is the same as that of the body, when the body is going to reach an object in a deep hole, and the outer diameter of the sleeve is larger than an inner diameter of the deep hole, the sleeve is not restricted by the first end face of the body and is movable along the body so that the body is inserted into the deep hole.

6. The apparatus as claimed in claim 1, wherein the engaging member has a curved outer face, multiple oval patterns radially protrude beyond the curved outer face.

7. The apparatus as claimed in claim 1, wherein the second engaging portion has two openings to provide flexibility to the second engaging portion.

8. The apparatus as claimed in claim 1, wherein the sleeve and the engaging member have different colors.

* * * * *